United States Patent [19]

Stewart et al.

[11] Patent Number: 4,615,784

[45] Date of Patent: Oct. 7, 1986

[54] NARROW GAP RETICULATE ELECTRODE ELECTROLYSIS CELL

[75] Inventors: James J. Stewart, Chardon; Donald W. Abrahamson; Marilyn J. Harney, both of Painesville, all of Ohio

[73] Assignee: Eltech Systems Corporation, Boca Raton, Fla.

[21] Appl. No.: 741,491

[22] Filed: Jun. 5, 1985

Related U.S. Application Data

[63] Continuation of Ser. No. 386,934, Jun. 10, 1982, abandoned.

[51] Int. Cl.[4] ..... C25B 9/00; C25B 11/03

[52] U.S. Cl. ..... 204/263; 204/283; 204/284; 204/290 R

[58] Field of Search ..... 204/263–266, 204/283–284, 279, 290 R, 16, 24, 252

[56] References Cited

U.S. PATENT DOCUMENTS

| | | | |
|---|---|---|---|
| 4,336,124 | 6/1982 | Gerard et al. | 204/284 |
| 4,401,519 | 8/1983 | Kadija et al. | 204/290 R X |
| 4,417,959 | 11/1983 | Kadija et al. | 204/283 X |
| 4,515,672 | 5/1985 | Platek et al. | 204/284 X |

FOREIGN PATENT DOCUMENTS

| | | | |
|---|---|---|---|
| 2104198 | 8/1972 | Fed. Rep. of Germany | 204/255 |

*Primary Examiner*—Donald R. Valentine
*Attorney, Agent, or Firm*—John J. Freer

[57] ABSTRACT

A reticulate primary electrode, usually cathode, and method for making for use in an electrochemical cell. The cathode is openly porous, in substantial physical contact with a separator used in the cell for separating anode and cathode compartment within the cell, and intermetallically bound to a cathodic current collector used within the cell.

9 Claims, 1 Drawing Figure

NARROW GAP RETICULATE ELECTRODE ELECTROLYSIS CELL

This is a continuation of application Ser. No. 386,934, filed June 10, 1982, now abandoned.

FIELD OF THE INVENTION

This invention relates to electrolytic cells, and particularly to cells producing an alkaline cathode product such as chloralkali generation cells. More specifically this invention relates to improved cathodes and cathode assemblies for use in these electrochemical cells, and to methods for making these improved cathodes ad assemblies.

BACKGROUND OF THE INVENTION

Electrolytic cells for the generation of chemical reaction products are widely employed. One field particularly where these cells have found widespread use is in generation of halogens and caustic compounds from salts of the halogen. In such cells, the halogen is generally evolved at the anode, while the caustic compound is evolved adjacent the cathode.

Recently a considerable effort has been directed towards the development of improved anode configurations that enable operation of the electrochemical cell more efficiently. These efforts have born fruit in the development of such improvements as dimensionally stable anodes DSA ® a proprietary anode coating system of Diamond Shamrock Corporation. Anode improvements have assisted in improving economics in operating chloralkali cells.

In cells where a separator such as a diaphragm separates the cell defining anode and cathode compartments, considerable effort has been devoted to development of improved separators. Separators based, for example, upon perfluorocarbon copolymers and having pendant cation exchange functional groups have been identified as providing, under certain cell operating conditions, the opportunity for achieving considerable economic advantage in operating a cell.

One remaining inefficiency in electrochemical cell operation is associated with power inefficiencies having their root in spacing imposed in most conventional cells between the separator and anodes and cathodes utilized in the cell. A variety of reasons can exist for the presence of the spacing. One common reason relates, for example, to gas bubble release difficulties where an electrode is pressed into a relatively soft separator such as a diaphragm type separator.

Spacing between anode and cathode in an electrochemical cell requires electrical current to follow a current pathway through cell electrolyte(s) where resistance to current passage can be relatively elevated. Generally, wider spacings between anode and cathode require that a more elevated voltage be applied to the cell to effect the desired electrochemical reaction. This elevated voltage requirement adds to electrical power consumption in operating the cell, adding to costs of cell operation.

A number of proposals exist focused upon reducing anode cathode spacing within a cell, and thereby reducing power consumption associated with cell operation. Reduced anode cathode spacing has been proposed for application to cells separated by a hydraulically permeable diaphragm and by a hydraulically impermeable membrane.

In diaphragm cells, for example, the spacing between anode and cathode has been reduced until one or both of the electrodes contacts the diaphragm. Many diaphragms are fabricated from materials which subject the diaphragm to swelling in cell environment. Electrodes utilized in such cells are frequently of a wire or mesh construction. Swelling of a diaphragm in contact with such an electrode can cause partial plugging of apertures in the electrode leading to poor release of gas bubbles being generated adjacent the electrode, and restricted flow of electrolyte from anode to cathode compartment through the diaphragm. One resulting repercussion can be an overvoltage at the electrode offsetting power gains achieved by reducing anode cathode spacing at least in part.

In membrane cells, the membrane, generally a cation exchange material, is normally quite thin, being on the order of a few mils. In addition such membranes frequently exhibit substantial dimensional stability, making placement of electrodes adjacent the membranes feasible without substantial risk of membrane expansion plugging apertures in the electrode. However when mesh electrodes or those fabricated from wire are placed adjacent a membrane allowing the electrodes to be within a few mils of one another, lines of electric flux between the individual elements of the electrodes do not always encompass all of the membrane material separating the anode and cathode resulting in inefficient use of the membrane and a corresponding increase in voltage drop attributable less than optimal electrolytic flux through the membrane.

Additionally, where a grid or mesh type electrode is contacted with a membrane, gas bubbles tend to agglomerate within apertures of the grid and these gas bubbles often lead to an overpotential at the electrode.

In one proposal for a closer anode to cathode spacing, as shown for example in U.S. Pat. Nos. 4,253,924; 4,253,922; and 4,250,013, a porous perhaps conductive secondary electrode material is utilized to fill, particularly the cathode compartments of the cell, and to press a primary electrode into contact with a cell membrane. An interface between the primary electrode and the porous secondary electrode material can substantially contribute to electrode resistance between the two and at least partially negate advantages otherwise available from the large electrode surface area potentially presented by the secondary electrode materials.

A cell configuration wherein a primary foam or reticulate electrode contacts a cell divider offers potential for improved economics in the operation of electrolyte.

DISCLOSURE OF THE INVENTION

The present invention provides a electrode assembly for use in electrochemical cells wherein a separator divides the cell into anode and cathode compartments. A porous reticulate, generally in the form of an openly porous foam appearing structure, substantially fills the electrode compartment, being in substantial physical contact with the separator. A current collector is bound intermetallically to the electrode so that voltage losses associated with the transfer of electrical current between the electrode and collector are negligible. Electrolyte distribution means are provided for introducing electrolyte into and removing electrolyte from the electrode.

The electrode assembly of the instant invention is made by substantially filling an electrode compartment of a cell with the porous electrode material generally of a foamed nature so that the foam substantially physically contacts the separator. The foam, made conductive, is subjected to deposition techniques whereby an electrode metal is coated upon the foam forming a reticulate electrode. A current feeder is provided for electrical contact with the foam and is intermetallically bound to the foam electrode in substantial electrical contact with the foam or reticulate electrode.

These reticulate electrodes, generally cathodes, can be made conductive by conventional techniques such as carbon impregnation and electroless plating. Electrodeposition can be accomplished by conventional techniques. These techniques can be applied in situ within the electrolytic cell, or external to the cell.

One advantage to the method of the instant invention for making electrode assemblies is that the steps can be performed interchangeably. That is the foam may be cut to size first, made conductive first, or made conductive and electroplated before cutting. This flexibility permits wide options in fabricating cells for a variety of end uses.

With a porous foam or reticulate electrode in contact with the separator, only the thickness of the separator need space anode from cathode within the cell, reducing voltage requirements associated with electrical current travel through the cell electrolyte. Forced circulation of electrolyte through the porous electrode can assist in suppressing bubble accumulation adjacent surfaces of the separator in contact with the electrode and can function to reduce concentration gradients within the electrode compartment particularly adjacent the separator. Since concentration gradients and bubble formation both can contribute to overpotentials, their reduction can lower voltages required for operating an electrochemical cell utilizing the electrode assembly of the instant invention.

The above and other features and advantages of the invention will become apparent from the following detailed description of the invention made with reference to the accompanying drawing which together form part of the specification.

BEST EMBODIMENT OF THE INVENTION

Figure 1:
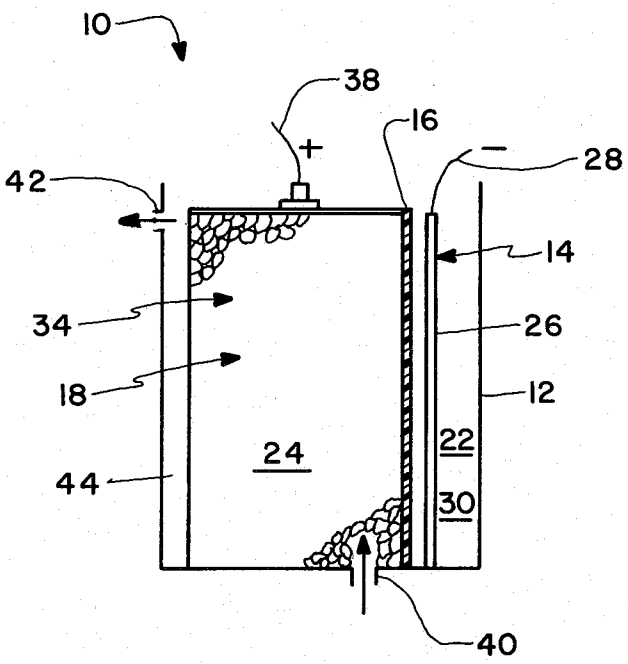
FIG. 1 is a cross sectional representation of an electrochemical cell embodying a cathode assembly of the instant invention.

Referring to the drawing, FIG. 1 shows an electrochemical cell 10, in this best embodiment a chloralkali cell, in cross section. The cell includes a housing 12, an anode assembly 14, a separator 16, and a cathode assembly 18.

The housing 12 can be of any suitable or conventional material relatively chemically inert to electrochemical contents of the cell. Where, as in this best embodiment, the electrochemical call is one for the generation of chlorine and caustic products from a brine of an alkali metal halogen to salt, the housing can be fabricated from a plastic material such as polypropylene. Generally a cell cover, not shown, is fitted to the upper portion of the cell during operation.

The cell is divided into anode 22 and cathode 24 compartments by the separator 16. This separator can be either of a hydraulically porous nature such as a diaphragm or be of a hydraulically impervious nature such as a cation exchange membrane. Where the separator is of a diaphragm nature, the diaphragm can be one prepared by any of a variety of well known techniques to yield a hydraulically permeable separator. Generally such diaphragm separators include asbestos fibers when fabricated for use in a chloralkali cell.

Where the cell is divided by a membrane, the membrane generally separates the compartments 22,24 in a manner precluding free fluid movement between the compartments. It is necessary that this membrane transmit electrical current between the compartments, and therefore such membranes are generally capable of transmitting a particular ion or charged species between the compartments. Where electrolyte contents of the electrochemical cell include aggressive compounds, it is desirable that the membrane be fabricated from a compound substantially resistant to aggressive attack by electrolyte contained in the compartments.

For a chloralkali cell of this best embodiment, this membrane may be of a suitable or conventional material resistant to aggressive materials included in electrolytes contained in each compartment 22,24. One much preferred material is a perfluorinated copolymer having pendant cation exchange functional groups. These perfluorocarbons are a copolymer of at least two monomers with one monomer being selected from a group including vinyl fluoride, hexafluoropropylene, vinylidene fluoride, trifluoroethylene, chlorotrifluoroethylene, perfluoro (alkylvinyl ether), tetrafluoroethylene and mixtures thereof.

The second monomer often is selected from a group of monomers usually containing an $SO_2F$ or sulfonyl fluoride pendant group. Examples of such second monomers can be generically represented by the formula $CF_2{=}CFR_1SO_2F$. $R_1$ in the generic formula is a bifunctional perfluorinated radical comprising generally 1 to 8 carbon atoms but upon occasion as many as 25. One restraint upon the generic formula is a general requirement for the presence of at least one fluorine atom on the carbon atom adjacent the $-SO_2F$ group, particularly where the functional group exists as the $-(-SO_2NH)mQ$ form. In this form, Q can be hydrogen or an alkali or alkaline earth metal cation and m is the valence of Q. The $R_1$ generic formula portion can be of any suitable or conventional configuration, but it has been found preferably that the vinyl radical comonomer join the $R_1$ group through an ether linkage.

Such perfluorocarbons, generally are available commercially such as through E. I. duPont, their products being known generally as NAFION. Perfluorocarbon copolymers containing perfluoro(3,6-dioxa-4-methyl-7-octenesulfonyl fluoride) comonomer have found particular acceptance in $Cl_2$ cells. Where sodium chloride brine is utilized for making chloralkali products from an electrochemical cell, it has been found advantageous to employ membranes having their preponderant bulk comprised of perfluorocarbon copolymer having pendant sulfonyl fluoride derived functional groups, and a relatively thin layer of perfluorocarbon copolymer having carbonyl fluoride derived functional groups adjacent one membrane surface.

The anode compartment 22, includes an anode 26, and an anodic current feeder 28. The current feeder 28 communicates with a source of electrical current, not shown. An electrolyte 30 generally fills void space within the anode compartment. Generally this electrolyte 30, or anolyte is a brine of an alkali metal halogen salt prepared according to well known methods. The compositions of these brines are generally well known in the industry.

The anode 26 is fabricated of a suitable or conventional material suitably resistant to the anolyte and to halogen compounds being generated within the electrolytic cell. Typically titanium is utilized having an applied coating of one or more metals or metal oxides such as ruthenium oxide. DSA® anodes, available from Diamond Shamrock Corporation are well suited for use in a cell such as is shown in this best embodiment.

The anode 26 can be positioned immediately adjacent the separator; or at a distance from the separator. In one equally preferred alternate to this preferred embodiment a catalyst such as ruthenium oxide attaches directly to the separator, a membrane, in contact with a grid or mesh like current collector.

The cathode compartment 24 includes a cathode assembly 18. The cathode assembly 18 comprises a foam like reticulate cathode 34, a cathodic current feeder 38 and an inlet 40 and outlet 42 for electrolyte. The cathode compartment is generally filled with an electrolyte or catholyte that includes a hydroxide of the alkali metal included in the halide salt forming the brine. This catholyte also fills that portion 44 of the cathode compartment 24 not occupied by the cathode 34.

The cathode is of an openly porous reticulate nature. While pores can be of any suitable or conventional size, pores of between 0.5 mil and 10 millimeters are preferred, with pores of between about 1 and 5 millimeters being much preferred. By openly porous what is meant is that the cathode is substantially hydraulically permeable throughout its structure.

The cathode 34 includes a substrate formed of a resinous or plastic material such as urethanes, polyesters, olifin polymers such as polypropylene or polyethylene, or other suitable or conventional materials. This substrate is utilized in the form of a foam, and need not be a rigid foam.

The substrate is encapsulated at least in part by one or more coatings of at least one conductive cathode metal. These coatings can be applied to the substrate in any suitable or conventional manner such as by electrodeposition. For electrodeposition, electrical conductivity of the resinous or plastic foam substrate generally is required. The foam substrate generally can be made conductive by suitable or conventional well known techniques such as electroless plating, or by impregnation with a conductive substance such as carbon.

Application of the coating metal renders the foam reticulate conductive and thereby suitable for use as a cathode. While a variety of cathode metals are known, for purposes of this best embodiment in the context of a chloralkali cell, nickel and/or copper are preferred. Particularly nickel appears to function in assisting the electrochemical reaction at the cathode. Metal coating upon the substrate need be only sufficiently thick and continuous to provide a negligible resistance to electrical current flow through the cathode to a point of electrical current collection.

The reticulate cathode is contained in the cathode compartment 24 generally in contact with the separator. Since the foam reticulate becomes relatively rigid upon application of the metal coating, it is often preferred that the foam be sized for being received in the cathode compartment prior to application of the metal coating.

The reticulate cathode functions as a primary electrode within the cell. Electrical current is supplied to this reticulate primary cathode via the cathodic current feeder 38. It is much preferred that electrical resistance associated with any electrical interconnection between the reticulate cathode and the current feeder 38 be negligible. Preferably this low electrical resistance is accomplished by making the connection intermetallic in nature.

One method by which the cathodic current feeder can be attached to the reticulate cathode is by inserting the current feeder 38 into the foam substrate of the reticulate cathode 34 prior to application of the coating metal. Insertion can be accomplished by slitting the foam substrate of the reticulate structure and inserting the current feeder, heating the current feeder to a temperature in excess of the melting temperature of the foam and immersing the heating feeder into the foam, coextrusion or forming of the foam with the current feeder embedded. Intermetallic joining of the current feeder and reticulate cathode can then be accomplished by electrodeposition of the metal for coating the foam substrate while utilizing the current feeder for supplying electrical current for the electrodeposition of the coating metal.

The inlet 40 and outlet 42 are arranged to provide circulation of catholyte through the foam reticulate cathode. The reticulate cathode being porous, catholyte is relatively readily forced through the cathode using any suitable or conventional means such as by pumping. One or more inlets and/or outlets can be provided depending upon the size of the cathode, the degree of circulation desired and other factors.

In operation of the electrolytic chloralkali cell of this best embodiment, metal ions, usually sodium ions, traverse the separator from the anode compartment, at least partially in response to electrical current flowing through the cell. These sodium ions react at the cathode with hydroxyl radicals being produced by the disassociation of water at the cathode, but remain in ionic solution. As operation of electrochemical cell continues, the concentration of these metal ions adjacent the separator typically can increase, providing a concentration gradient resistance to further migration of metal ions. Overcoming this resistance would ordinarily require a more elevated cell voltage between the anode and cathode within the cell, consequently increasing power requirements for cell operation. Circulation, tending to reduce this concentration gradient resistance or overpotential, can avoid an increased power consumption in cell operation.

The disassociation of water ongoing at the cathode can produce hydrogen, forming into bubbles. Where these bubbles adhere to the cathode these bubbles can effectively reduce the cathode surface available for electrochemical reaction, resulting in an electrical resistance or overpotential. Circulation of catholyte through the reticulate cathode can reduce bubble adherence, and thereby avoid an elevated operational cell voltage that might otherwise be required to compensate for this bubble overpotential.

The volume of catholyte desirably circulated through the cathode can vary, with generally lower flow rates being preferred to conserve power. Flow rates of between about 1 liter per minute per cubic meter of reticulate cathode and 250 liters per minute. Only a flow rate sufficient to avoid bubble and concentration overpotential need be utilized.

It is not necessary that the reticulate cathode 34 fill the cathode compartment 24 entirely. The reticulate foam cathode need only fill portions of the cathode compartment adjacent the separator and be in substantial physical contact with the separator. Where the reticulate cathode does not fill the cathode compartment completely, the balance of the cathode compartment can be filled with a resistant material such as a foam capable of functioning to bias the reticulate cathode into contact with the separator. Alternately, a reticulate cathode not completely filling the cathode compartment can be biased into contact with the separator in any suitable or conventional manner such as by using a resilient grid.

In one alternate of the best embodiment, the cathodic current collector is first embedded in the foam substrate of the reticulate cathode. The foam substrate is fitted to the cathode compartment of the cell. Where the foam substrate has not previously been rendered electrically conductive by reason of carbon impregnation or like process, a preliminary metal coating is applied to the foam substrate by electroless plating techniques. Generally this electroless plating can be accomplished within the confines of the electrolytic cell, and in most preferred applications is conducted primarily to impart conductivity to the foam substrate for subsequent electrodeposition of cathode metal.

Subsequent metal electrodeposition onto the reticulate cathode assembly being formed preferably is conducted within the confines of the electrolytic cell. Plating solution is introduced into the cathode compartment, and the cathodic current feeder is connected to a source of electrical current. Metal ions contained in the plating solution thereby become deposited upon the reticulate foam substrate using well know plating techniques.

During electrochemical cell operation this catholyte metal deposited upon the foam substrate is cathodically protected from the action of aggressive chemicals present in the catholyte. In a chloralkali cell where the separator is a cation exchange membrane, metal ions such as sodium ions traverse the membrane from the anode compartment and react with the hydroxyl radicals being produced at the reticulate cathode to create a metal hydroxide solution comprising the catholyte. Hydrogen gas is evolved. By periodic removal of some catholyte from the catholyte being circulated through the reticulate cathode, and replacement with water, metal hydroxide concentration within the catholyte can be controlled within desired, well known preferred limits in the operation of a membrane chloralkali cell.

Where the reticulate separator contacts a porous separator such as a diaphragm, brine containing ions of the metal flows through the diaphragm to the cathode compartment joining catholyte circulating through the cathode compartment. Removal of circulating catholyte compensates in well known manner for spent brine volumes traversing the separator, and controls metal hydroxide concentration in the circulating catholyte.

Anodes may be fabricated for use in electrolytic cells in a fashion identical to the formation of the foam or reticulate cathode assemblies described supra. Such foam or reticulate anodes may be utilized in electrochemical cells and substantial physical contact with a separator dividing anode and cathode compartments in the cell. Frequently it is advantageous that anodes fabricated in accordance with this invention include a top-coating or electrocatalytic coating applied after formation of the foam or reticulate anode assembly. Typical coatings would include DSA®, or TIR-2000, proprietary coatings system manufactured by Diamond Shamrock Corporation and other suitable or conventional electrode coatings.

The following examples further illustrate the invention.

EXAMPLE 1

A nickel reticulate cathode was prepared by first attaching a nickel current distributor, fabricated from nickel grid sheet stock, to a conductor bar. The grid and conductor bar were then heated above the melting point of polyurethane foam, the foam being sized to occupy substantially the entirety of the cathode compartment of an electrolytic cell. The hot conductor bar with grid was set into the foam and permitted to cool. With cooling, foam melted by the heat of the conductor bar and grid fused to the grid. The resulting cathode assembly was then plated. Such plated cathodes functioned effectively in electrolytic cell where the foam contained between 10 and 45 pores per inch (ppi).

For plating the cathode assembly was immersed in a room temperature bath consisting of an aqueous solution of 10 gram per liter (gpl.) tin chloride and 10 milliliter (ml) per liter hydrochloric acid (20° C. After 5 minutes, the cathode assembly was rinsed gently in room temperature water, and then immersed in an aqueous solution of 0.5 gpl. $PdCl_2$ and 10 ml per liter hydrochloric acid for five minutes. Following an aqueous rinse, the foam cathode assembly was immersed for 10 minutes at 50° C. in a mixture comprising one liter of an aqueous solution of 45 gpl. nickel chloride hexahydrate, 50 gpl. ammonium chloride, 100 gpl. sodium nitrate, 0.5 liters per liter ammonium hydroxide and 27.3 ml of a 450 gpl. aqueous solution of sodium hypophosphite. These preceding steps deposited an electroless nickel plate upon the cathode assembly.

Electroless plating was followed by nickel electrolytic plating. The cathode assembly was immersed in an aqueous solution of 141 gpl. nickel chloride hexahydrate, 291 gpl. nickel sulfate hexahydrate and 45 gpl. phosphoric acid, with the solution being adjusted to a pH of 4.5 to 6.5 using hydrochloric acid. The cathode assembly was made cathodic to nickel anodes mounted approximately 3.8 centimeters from the surfaces of the foam cathode assembly, and plating was conducted at 2.25 volts for 3 hours at 30°–40° C. Plating is continued until a coating of 10 microns thickness or greater was established upon the foam.

Optionally, after 1½ hours of plating, the polyurethane foam may be ashed by placing the reticulate in a flame or oven until the foam is burned out. After rinsing, plating can then be continued.

EXAMPLE 2

A nickel reticulate cathode was prepared in accordance with Example 1, except that after completion of electroless plating the cathode assembly was immersed in an aqueous solution of 250 gpl. nickel chloride hexahydrate, and 50 gpl. zinc chloride. This solution was maintained at 45° C. with a pH of approximately 4.5, adjusted by the addition of HCl. Nickel and nickel zinc anodes were placed in close proximity to surfaces of the cathode assembly for about one hour and made anodic to the cathode assembly at 2.00 volts. The solution was agitated during the electrolytic plating operation.

Following completion of electrolytic plating, the cathode assembly was immersed in an aqueous solution of 200 gpl. sodium hydroxide for one hour at 75° C.

EXAMPLE 3

The fabrication steps of Example 1 were repeated except that electrolytic plating was conducted from an aqueous solution comprising 265 gpl. cobalt chloride hexahydrate, 90 gpl. zinc chloride, and 30 gpl. boric acid at 50° C. and a pH of 4 maintained by the addition of hydrochloric acid. Zinc anodes, mounted approximately an 3.8 centimeters from surfaces of the cathode assembly were utilized to plate at 0.6 volts zinc onto the cathode assembly over a period of one hour.

EXAMPLE 4

A cathode assembly was prepared in accordance with Example 1 except that the current distribution grid was fabricated from copper in lieu of nickel. An electroless copper plate was deposited on the polyurethane foam by immersing the cathode assembly for 5 minutes at room temperature sequentially into two baths. The first bath contained 10 gpl. tin chloride and 10 ml per liter hydrochloric acid (20° C.). The second bath contained 0.5 gpl. palladium chloride and 10 ml per liter hydrochloric acid (20° C.). After each bath a water rinse at room temperature was conducted. The cathode assembly was then soaked for 20 minutes at room temperature in commercial copper electroless plating solution made by mixing 777A and 777M Cu Electroless Makeup (available from CuTech Inc.) in a 1:1:8 ratio with water and then rinsed gently.

The cathode assembly was then immersed in a electrolytic plating bath comprising an aqueous solution of 40 gpl. copper as copper sulfate, 10 gpl. sulfuric acid and having a pH of 1 maintained by the addition of sulfuric acid at room temperature. Copper electrodeposition was conducted by placing copper anodes 3.8 centimeters from surfaces of the cathode assembly, making the cathode assembly cathodic to these copper anodes, and passing 1½ volts between them for approximately 1 hour. Optionally the polyurethane foam may be ashed in accordance with Example 1 approximately half-way through the electrodeposition.

Since copper by itself may be excessively subject to corrosion/attack in a chloralkali cell cathode compartment, advantageously the copper electroplated cathode assembly was then nickel plated in accordance with the electrolytic plating step of Example 1.

EXAMPLE 5

A cathode assembly was prepared by attaching a current feeder to a current distribution grid fabricated from nickel in accordance with Example 1. Heated, the current distribution grid and current feeder were immersed into a polyurethane foam in accordance with Example 1 resulting in a foam or reticulate cathode assembly.

The foam cathode assembly was then electrolessly plated with copper in accordance with Example 4 and received an electrolytic copper plating in accordance with Example 4. An electrolytic nickel plate was then applied to the foam cathode assembly in accordance with Example 1.

An electrolytic deposition of nickel and zinc was then made to the reticulate cathode assembly in accordance with Example 2.

EXAMPLE 6

A cathode assembly was prepared in accordance with Example 1. Following application of the electrolytic nickel a palladium oxide-zirconium oxide coating was applied to the cathode. Application was accomplished by ball milling a slurry of 10 ml of water, 1 ml of acetic acid, 1.5 grams of palladium chloride particles and 2 grams of zirconyl nitrate for two hours to stabilize the palladium chloride and reduce the size of any non-solubilized material particles. This slurry was then brushed onto the nickel plated reticulate cathode assembly of Example 1 which had been ashed in accordance with Example 1. The brush coating and cathode were heated at 125° C. for minutes and then cured at 500° C. for 7 minutes in air thereby converting the palladium chloride to palladium oxide and the zirconyl nitrate to zirconium dioxide. Four additional coatings of the slurry were then applied and cured. In alternate preparation techniques, as much as one-half of the palladium chloride was replaced by cobalt and/or nickel in preparing the cathode.

EXAMPLE 7

A foam or reticulate cathode assembly was made in accordance with the steps of Example 1 including the application of nickel electrolytic plate. Following electrolytic plating with nickel, the foam cathode assembly was immersed in an electrolytic plating bath comprising one gallon of water, 20 grams sulfamic acid, and 20 grams of ruthenium as ruthenium sulfamate. The bath was maintained at between 80 and 100° F. and electrodeposition was conducted using platinum anodes spaced approximately 3.8 centimeters from surfaces of the foam cathode assembly. With the foam cathode assembly made cathodic, current was passed between the platinum anodes and the foam cathode assembly at a density of 0.15 amps per square centimeter at 1.75 volts.

EXAMPLE 8

A foam or reticulate cathode assembly was prepared in accordance with Example 1 including electrolytic nickel plating. Following the electrolytic nickel plate, the foam cathode assembly was immersed in an agitated coating solution containing 5 ml of $H_3Pt(SO_3)_2OH$ in 150 ml of water adjusted to a pH of 3 by the use of 1 normal NaOH, and including approximately 15 ml of a 30% hydrogen peroxide solution. The foam cathode assembly was soaked in this peroxide containing solution for approximately one hour during which the pH gradually dropped to 1. The pH was then restored to 3 using one normal caustic and the solution and cathode assembly were heated to 80° C. while agitating the peroxide containing solution until all peroxide bubbling stopped. After washing, the foam cathode assembly was dried at 125°–150° C.

EXAMPLE 9

A foam cathode assembly was prepared in accordance with Example 1 including electrolytic nickel plating. Sintering or ashing was conducted in accordance with Example 1. Following electrolytic deposition of nickel, a coating of aluminum was applied by plasma spraying onto surfaces of the foam cathode assembly. The assembly was then heat treated at 760° C. for 8 hours in a nitrogen atmosphere interdiffusing the nickel and aluminum. In actual operation of a chloralkali cell using such a cathode, the aluminum would be leached from the interdiffused surface by hot NaOH contained within the cell. Leaching provides greater surface area on the foam cathode assembly than available without interdiffusing and leaching.

EXAMPLE 10

A foam or reticulate cathode assembly was prepared in accordance with Example 1 except that electrolytic plating was accomplished by immersing the foam cathode assembly into an aqueous solution of 240 gpl. ferrous sulfate at a pH of 2.8 to 3.5 and a temperature of between 32° C. and 66° C. The cathode assembly was made cathodic to iron anodes available from Armco Steel Company positioned approximately 3.8 centimeters from the surfaces of the cathode assembly. Plating was conducted for between 1 and 3 hours at between 0.04 amps per square centimeter and 0.11 amps per square centimeter. The ferrous sulfate bath was agitated during electrodeposition to assist in providing a uniform coating upon the foam cathode assembly.

EXAMPLE 11

A foam or reticulate cathode assembly was fabricated in accordance with Example 4 and then subjected to electrodeposition with iron in accordance with Example 10.

EXAMPLE 12

A foam or reticulate cathode assembly was prepared in accordance with Example 1 including sintering or ashing intermediate during the electrodeposition operation. The cathode assembly was then plasma sprayed with a mixture of 80% nickel, 10% molybdenum and 10% aluminum. The molybdenum and aluminum were then leached in hot sodium hydroxide by operation in a chloralkali cell. A cathode assembly having a substantially elevated surface area resulted.

EXAMPLE 13

Example 1 was repeated except using as a starting material polyurethane foam 1.25 centimeters in thickness made by laminating four thicknesses of 0.32 centimeters foam. A structure indistinguishable from the structure of Example 1 resulted.

EXAMPLE 14

Two electrolytic cells were operated in parallel. One cell was equipped with an anode made in accordance with Example 1. The cathode in this first cell was a perforated nickel plate. The cell included a separator fabricated from NAFION® 295, a product of E. I. duPont deNemours and Company, a cation exchange material suitable for use in electrolytic chloralkali cells. The cell was fed with an aqueous stream of sodium bicarbonate and sodium carbonate in a 1:1 molar ratio.

The second cell was equipped identically with the first cell except that the cathode in the second cell was a porous foam or reticulate cathode made in accordance with Example 1. This second cell operated on this same feed materials as the first cell.

In both cells, the electrodes were in substantial physical contact with the separator. The first cell operated at a voltage of 2.82 volts under current flow of 0.15 amps per square centimeter, while the second cell demonstrated a voltage of 2.63 volts at 0.15 amps per square centimeter. The first cell demonstrated a voltage of 3.33 volts at 0.31 amps per square centimeter, while the second cell demonstrated a voltage of 3.05 volts a 0.31 amps per square centimeter. Current efficiency between the cells was equivalent within experimental laboratory accuracy. The second cell, because of the presence of the nickel reticulate or foam cathode assembly, operated at a significantly lower voltage which, in a commercial operation, would result in a lower power requirement for cell operation. The nickel reticulate or foam cathode assembly provided an operational advantage of 200 millivolts at 0.15 amps per square centimeter and 280 millivolts at 0.15 amps per square centimeter.

EXAMPLE 15

Two electrolytic cells were operated in parallel. One cell included an anode fabricated from a titanium mesh having diamond shaped openings approximately 0.64 centimeters by 0.32 centimeters and coated with a DSA® electrocatalytic coating for the production of chlorine. DSA® coated titanium mesh is available from Diamond Shamrock Corporation and generally includes ruthenium oxide as a surface coating. The cathode in this first cell was formed from nickel mesh having diamond shaped apertures also approximately 0.64 centimeters by 0.32 centimeters. The cell included a separator made from duPont NAFION® 295, both the anode and cathode being in intimate contact with the NAFION® separator. The cell compartment defined by the separator and containing the anode was fed with sodium chloride brine (170 grams per liter).

The second cell in the parallel pair was equipped identically except that the cathode provided was a foam or reticulate cathode assembly made in accordance with Example 1. This cathode, as well as the anode in the second cell, were in intimate contact with the separator. The feedstock to this second cell was identical with the feedstock of the first cell. Both cells were operated at 0.31 amps per square centimeter of membrane surface area with the first cell requiring 3.84 volts and the second cell at 3.18 volts for electrolysis. Current efficiencies were equivalent. Use of a reticulate foam electrode provided the second chlorine generation cell with an advantage of 660 millivolts at 0.31 amps per square centimeter.

EXAMPLE 16

Two cells were operated in parallel One cell included an anode fabricated from a titanium mesh having a DSA® electrocatalytic coating applied to the mesh. Apertures in the mesh were approximately 0.32 centimeters by 0.32 centimeters. The cathode in this first cell was fabricated from nickel mesh having the same aperture dimensions. Anode and cathode were in contact with and separated by a NAFION® 290 cation exchange membrane. A 170 gram per liter sodium chloride brine was fed to a compartment of the cell defined by the separator containing the anode.

The second cell of this parallel pair included an identical anode and separator but was fabricated utilizing a nickel foam or reticulate cathode assembly made in accordance with Example 1. Feedstock to this second cell was identical with the feed to the first cell. While the first cell operated at 3.28 volts generating chlorine at a current density of approximately 0.3 amps per square centimeter measured at the separator, the second cell achieved an operating voltage of 3.13 volts operating at an identical current density. Current efficiencies of the cells were identical.

EXAMPLE 17

Two cells were operated in parallel. In one cell the anode was a porous foam reticulate anode structure fabricated in accordance with Example 1. The first cell included a cathode fabricated from perforated nickel plate. The foam or reticulate anode assembly and nickel plate were in substantial contact with a microporous separator fabricated from polypropylene. 300 gram per liter sodium carbonate was fed to this cell.

The second cell contained an identical anode and separator but included a foam or reticulate cathode assembly in contact with the separator, the foam or reticulate cathode being made in accordance with Example 1. An identical feedstock was provided to this second cell. While the first cell operated at 2.72 volts at a current density of 0.15 amps per square centimeter, the second cell achieved a 2.44 operating voltage at an identical current density. Within experimental error, the current efficiencies of the two cells were equivalent. The cell operated using a reticulate cathode achieved a 280 millivolt operating advantage over an identical cell operated without the reticulate cathode.

EXAMPLE 18

Two cells were operated in parallel. The first cell included a cathode fabricated from perforated nickel plate in intimate contact with a porous ceramic alumina separator. The anode in this first cell was a sheet of titanium metal mesh having apertures of approximately 0.64 centimeters by 0.32 centimeters and coated with TIR2000 ® a Diamond Shamrock proprietary anode coating useful where it is desired that oxygen be evolved. This first cell was fed with 300 grams per liter sodium carbonate.

The second cell was operated equipped identically with the first cell except that the anode in the second cell was a foam or reticulate anode fabricated in accordance with Example 1. The feedstock to this second cell was identical to that of the first. While the first cell operated at 3.4 volts at 0.15 amps per square centimeter, the second cell, using the foam or reticulate anode assembly, operated at 2.72 volts at an identical current density. Current efficiency of the two cells within experimental error, was identical. The second cell, using the foam or reticulate anode assembly in contact with the separator, achieved a 0.680 volt operating advantage over a perforated nickel plate anode in contact with the separator.

While a preferred embodiment has been shown and described in detail, it should be apparent that various modifications and alterations may be made without departing from the scope of the claims following.

What is claimed is:

1. In an electrolytic cell having anode and cathode compartment defined by a separator, an electrode assembly comprising:

(a) an electrode/current feeder unit having an openly porous, reticulate electrode and a surface uniform current feeder of plated metal, said electrode substantially filling at least one of said compartments and in substantial physical contract with said separator, with the plating for the plated metal forming said electrode while intermetallically binding by electroplate only said current feeder and electrode together into said unit, whereby electrical current is distributed to the metal plate electrode with negligible electrical resistance between the electrode and current feeder; and (b) distribution means whereby electrolyte can be circulated into the reticulate electrode compartment and out of the electrode compartment.

2. The electrolytic cell of claim 1, wherein said reticulate electrode is in intimate contact with said separator.

3. The electrolytic cell of claim 1, wherein said reticulate electrode occupies substantially the entirety of at least one electrode compartment of said cell.

4. The electrolytic cell of claim 1, wherein said reticulate electrode substantially fills said compartment and the balance thereof is filled with foam material.

5. The electrolytic cell of claim 1, wherein said reticulate electrode is a rigid reticulate.

6. The electrolytic cell of claim 1, wherein said reticulate electrode contains an electrocatalytic coating.

7. The electrolytic cell of claim 1, wherein said reticulate electrode is an anode, cathode or both.

8. The electrolytic cell of claim 1, wherein said reticulate electrode has pores ranging in size from 0.5 mil to 10 millimeters and containing between about 10 and 45 pores per inch.

9. The electrolytic cell of claim 1, wherein said reticulate electrode is a metal plated plastic foam and said foam is burned out by heating.

* * * * *